US008716924B2

(12) United States Patent
Nasu et al.

(10) Patent No.: US 8,716,924 B2
(45) Date of Patent: May 6, 2014

(54) SPARK PLUG HAVING STRESS CORROSION CRACKING RESISTANCE

(75) Inventors: Hiroaki Nasu, Gifu (JP); Makoto Sugita, Nagoya (JP); Akito Sato, Obu (JP); Shingo Kuwahara, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/818,719

(22) PCT Filed: Apr. 12, 2011

(86) PCT No.: PCT/JP2011/002158

§ 371 (c)(1),
(2), (4) Date: Feb. 25, 2013

(87) PCT Pub. No.: WO2012/026049

PCT Pub. Date: Mar. 1, 2012

(65) Prior Publication Data

US 2013/0154468 A1 Jun. 20, 2013

(30) Foreign Application Priority Data

Aug. 26, 2010 (JP) ..... 2010-189069

(51) Int. Cl.
*H01T 13/39* (2006.01)

(52) U.S. Cl.
USPC ..... 313/141; 313/143; 445/7

(58) Field of Classification Search
USPC ..... 313/118–143; 445/7; 123/169 R, 123/169 EL, 32, 41, 310
See application file for complete search history.

(56) References Cited

U.S. PATENT DOCUMENTS

| | | | | |
|---|---|---|---|---|
| 4,193,012 | A * | 3/1980 | Podiak et al. | 313/137 |
| 6,366,008 | B1 | 4/2002 | Fukushima et al. | 313/141 |
| 6,688,932 | B2 * | 2/2004 | Nasu et al. | 445/7 |
| 8,237,341 | B2 * | 8/2012 | Freeman et al. | 313/141 |
| 8,421,324 | B2 * | 4/2013 | Nasu et al. | 313/141 |
| 8,550,865 | B2 * | 10/2013 | Uegaki et al. | 445/7 |
| 2003/0168955 | A1 | 9/2003 | Suzuki | 313/143 |

FOREIGN PATENT DOCUMENTS

| | | | |
|---|---|---|---|
| JP | 2002-184552 | 6/2002 | F02P 13/00 |
| JP | 2003-257583 | 9/2003 | H01T 13/20 |
| JP | 2007-23333 | 2/2007 | C25D 11/38 |
| JP | 2007-141868 | 6/2007 | H01T 13/36 |
| JP | 2007-270356 | 10/2007 | C25D 11/38 |

OTHER PUBLICATIONS

Int'l Search Report from corresponding PCT/JP2011/002158 (Form PCT/ISA/210); 1 page.

* cited by examiner

*Primary Examiner* — Tracie Y Green
(74) *Attorney, Agent, or Firm* — Kusner & Jaffe

(57) ABSTRACT

A spark plug having a metallic shell covered with a nickel plating layer and having a groove portion formed between a tool engagement portion and a gas seal portion and having an orthogonal-to-axis sectional area of 36 $mm^2$ or less.

16 Claims, 13 Drawing Sheets

1: METALLIC SHELL

1d: CRIMP PORTION

1e: HEXAGONAL PORTION

1f: GAS SEAL PORTION

1h: GROOVE PORTION

2: INSULATOR

3:CENTER ELECTRODE

FIG. 4

(1) Plating specifications: Ni strike plating + Ni plating
- Cross-sectional area of groove portion: 28 $mm^2$
- Outer surface: plating thickness on hexagonal portion 5 μm

| | | Plating thickness of sample and evaluation | | | | | | | | | | | | |
|---|---|---|---|---|---|---|---|---|---|---|---|---|---|---|
| Sample No. | | S101 | S102 | S103 | S104 | S105 | S106 | S107 | S108 | S109 | S110 | S111 | S112 | S113 |
| Ni plating conditions | Time (min) | 7.5 | 15 | 30 | 40 | 60 | 355 | 380 | 405 | 435 | 465 | 495 | 525 | 555 |
| | Current density ($A/dm^2$) | 2.4 | 1.2 | 0.6 | 0.45 | 0.3 | 0.051 | 0.047 | 0.044 | 0.041 | 0.039 | 0.036 | 0.034 | 0.032 |
| Ni plating thickness (μm) Inner surface: back side of groove portion lower end | | 0.05 | 0.1 | 0.2 | 0.3 | 0.4 | 1.8 | 1.9 | 2.0 | 2.1 | 2.2 | 2.3 | 2.4 | 2.5 |
| Stress corrosion cracking resistance | | F | F | F | C | A | A | C | C | F | F | F | F | F |

[Criteria]
- Stress corrosion cracking resistance
  (Judgment by elapse of time before cracking in groove portion)
  - A: 80 hrs or more
  - B: 50-80 hrs
  - C: 20-50 hrs
  - F: 20 hrs or less

FIG. 6

(2) Plating specifications: Ni strike plating + Ni plating + electrolytic trivalent chromate
- Cross-sectional area of groove portion: 28 $mm^2$
- Outer surface: plating thickness on hexagonal portion 5 μm

| | | Plating thickness of sample and evaluation | | | | | | | | | | | | |
|---|---|---|---|---|---|---|---|---|---|---|---|---|---|---|
| Sample No. | | S201 | S202 | S203 | S204 | S205 | S206 | S207 | S208 | S209 | S210 | S211 | S212 | S213 |
| Ni plating conditions | Time (min) | 7.5 | 15 | 30 | 40 | 60 | 355 | 379.7 | 405 | 435 | 465 | 495 | 525 | 555 |
| | Current density ($A/dm^2$) | 2.4 | 1.2 | 0.6 | 0.45 | 0.3 | 0.051 | 0.047 | 0.044 | 0.041 | 0.039 | 0.036 | 0.034 | 0.032 |
| Ni plating thickness (μm) Inner surface: back side of groove portion lower end | | 0.05 | 0.1 | 0.2 | 0.3 | 0.4 | 1.8 | 1.9 | 2.0 | 2.1 | 2.2 | 2.3 | 2.4 | 2.5 |
| Stress corrosion cracking resistance | | F | F | C | A | A | A | A | A | C | C | F | F | F |

[Criteria]
- Stress corrosion cracking resistance (Judgment by elapse of time before cracking in groove portion)

A: 80 hrs or more
B: 50-80 hrs
C: 20-50 hrs
F: 20 hrs or less

FIG. 7

(3) Plating specifications: Ni strike plating + Ni plating + rust prevention oil
- Cross-sectional area of groove portion: 28 $mm^2$
- Outer surface: plating thickness on hexagonal portion 5 μm

| | | Plating thickness of sample and evaluation | | | | | | | | | | | | |
|---|---|---|---|---|---|---|---|---|---|---|---|---|---|---|
| Sample No. | | S301 | S302 | S303 | S304 | S305 | S306 | S307 | S308 | S309 | S310 | S311 | S312 | S313 |
| Ni plating conditions | Time (min) | 7.5 | 15 | 30 | 40 | 60 | 355 | 380 | 405 | 435 | 465 | 495 | 525 | 555 |
| | Current density ($A/dm^2$) | 2.4 | 1.2 | 0.6 | 0.45 | 0.3 | 0.051 | 0.047 | 0.044 | 0.041 | 0.039 | 0.036 | 0.034 | 0.032 |
| Ni plating thickness (μm) Inner surface: back side of groove portion lower end | | 0.05 | 0.1 | 0.2 | 0.3 | 0.4 | 1.8 | 1.9 | 2.0 | 2.1 | 2.2 | 2.3 | 2.4 | 2.5 |
| Stress corrosion cracking resistance | | F | F | C | A | A | A | A | A | C | C | F | F | F |

[Criteria]
- Stress corrosion cracking resistance (Judgment by elapse of time before cracking in groove portion)

A: 80 hrs or more
B: 50-80 hrs
C: 20-50 hrs
F: 20 hrs or less

FIG. 8

(4) Plating specifications: Ni strike plating + Ni plating + electrolytic trivalent chromate + rust prevention oil
- Cross-sectional area of groove portion: 28 $mm^2$
- Outer surface: plating thickness on hexagonal portion 5 μm

| | | Plating thickness of sample and evaluation | | | | | | | | | | | | |
|---|---|---|---|---|---|---|---|---|---|---|---|---|---|---|
| Sample No. | | S401 | S402 | S403 | S404 | S405 | S406 | S407 | S408 | S409 | S410 | S411 | S412 | S413 |
| Ni plating conditions | Time (min) | 7.5 | 15 | 30 | 40 | 60 | 355 | 380 | 405 | 435 | 465 | 495 | 525 | 555 |
| | Current density ($A/dm^2$) | 2.4 | 1.2 | 0.6 | 0.45 | 0.3 | 0.051 | 0.047 | 0.044 | 0.041 | 0.039 | 0.036 | 0.034 | 0.032 |
| Ni plating thickness (μm) Inner surface: back side of groove portion lower end | | 0.05 | 0.1 | 0.2 | 0.3 | 0.4 | 1.8 | 1.9 | 2.0 | 2.2 | 2.2 | 2.3 | 2.4 | 2.5 |
| Stress corrosion cracking resistance | | F | C | A | A | A | A | A | A | A | A | C | C | F |

[Criteria]
- Stress corrosion cracking resistance
  (Judgment by elapse of time before cracking in groove portion)
  - A: 80 hrs or more
  - B: 50-80 hrs
  - C: 20-50 hrs
  - F: 20 hrs or less

FIG. 9

(5) Effect of plating thickness of hexagonal portion on corrosion resistance and plating peeling resistance (part 1)
- Plating specifications: Ni strike plating + Ni plating
- Cross-sectional area of groove portion: 28 $mm^2$

| | | Plating thickness of sample and evaluation | | | | | | | | |
|---|---|---|---|---|---|---|---|---|---|---|
| Sample No. | | S501 | S502 | S503 | S504 | S505 | S506 | S507 | S508 | S509 |
| Ni plating conditions | Time (min) | 16 | 24 | 32 | 40 | 72 | 120 | 128 | 136 | 160 |
| | Current density ($A/dm^2$) | 0.45 | | | | | | | | |
| Ni plating thickness (μm) | Outer surface: hexagonal portion | 2 | 3 | 4 | 5 | 9 | 15 | 16 | 17 | 20 |
| | Inner surface: back side of groove portion lower end | 0.3 | 0.3 | 0.3 | 0.3 | 0.3 | 0.3 | 0.3 | 0.3 | 0.3 |
| Corrosion resistance | | F | C | C | B | A | A | A | A | A |
| Plating peeling resistance | | A | A | A | A | A | A | F | F | F |

<Criteria>
- Corrosion resistance (after 48-hour spray of salt water)
  - A: No formation of red rust
  - B: Formation of red rust 5% or less
  - C: Formation of red rust 10% or less
  - F: Formation of red rust greater than 10%
- Plating peeling resistance
  (Judgment by condition of plating on crimp lid after crimping)
  - A: No lifting or peeling of plating
  - F: Occurrence of lifting or peeling of plating

FIG. 10

(5) Effect of plating thickness of hexagonal portion on corrosion resistance and plating peeling resistance (part 2)
- Plating specifications: Ni strike plating + Ni plating + electrolytic trivalent chromate + rust prevention oil
- Cross-sectional area of groove portion: 28 $mm^2$

| | | Plating thickness of sample and evaluation | | | | | | | | |
|---|---|---|---|---|---|---|---|---|---|---|
| Sample No. | | S601 | S602 | S603 | S604 | S605 | S606 | S607 | S608 | S609 |
| Ni plating conditions | Time (min) | 16 | 24 | 32 | 40 | 72 | 120 | 128 | 136 | 160 |
| | Current density ($A/dm^2$) | 0.45 | | | | | | | | |
| Ni plating thickness (μm) | Outer surface: hexagonal portion | 2 | 3 | 4 | 5 | 9 | 15 | 16 | 17 | 20 |
| | Inner surface: back side of groove portion lower end | 0.3 | 0.3 | 0.3 | 0.3 | 0.3 | 0.3 | 0.3 | 0.3 | 0.3 |
| Corrosion resistance | | F | C | B | A | A | A | A | A | A |
| Plating peeling resistance | | A | A | A | A | A | A | F | F | F |

<Criteria>
- Corrosion resistance (after 48-hour spray of salt water)
  - A: No formation of red rust
  - B: Formation of red rust 5% or less
  - C: Formation of red rust 10% or less
  - F: Formation of red rust greater than 10%
- Plating peeling resistance
  (Judgment by condition of plating on crimp lid after crimping)
  - A: No lifting or peeling of plating
  - F: Occurrence of lifting or peeling of plating

FIG. 11

(6) Effect of whether or not Ni strike plating is provided
• Test method: stress corrosion cracking resistance evaluation test
(N = 100 samples tested; judgment by the number of samples judged NG because of cracking in a test time of 24 hrs)
• Cross-sectional area of groove portion: 28 $mm^2$
• Plating specifications: Ni plating + electrolytic trivalent chromate + rust prevention oil

| | Samples having a large plating thickness on inner surface | Samples having a small plating thickness on inner surface |
|---|---|---|
| Ni strike plating provided | NG 0 /100 | NG 80 /100 |
| Ni strike plating not provided | NG 0 /100 | NG 95 /100 |

Samples having a large plating thickness on inner surface
(1) Plating thickness
• Plating thickness on outer surface of hexagonal portion: 5 μm
• Ni plating thickness on inner surface on back side of groove portion lower end: 0.3 μm
(2) Sample preparing conditions
• Ni plating time: 40 min
• Current density: 0.45 $A/dm^2$ Samples having a small plating thickness on inner surface
(1) Plating thickness
• Plating thickness on outer surface of hexagonal portion: 5 μm
• Ni plating thickness on inner surface on back side of groove portion lower end: 0.1 μm
(2) Sample preparing conditions
• Ni plating time: 15 min
• Current density: 1.2 $A/dm^2$

FIG. 12

(7) Effect of cross-sectional area of groove portion
- Test method: stress corrosion cracking resistance evaluation test
  (N = 100 samples tested; judgment by the number of samples judged NG because of cracking in a test time of 24 hrs)
- Plating specifications: Ni strike plating + Ni plating + electrolytic trivalent chromate + rust prevention oil

| | Evaluation | | | | | | | |
|---|---|---|---|---|---|---|---|---|
| Cross-sectional area of groove portion ($mm^2$) | 20 | 24 | 28 | 32 | 34 | 36 | 40 | 44 |
| Samples having a large plating thickness on inner surface | NG0 /100 | NG0 /100 | NG0 /100 | NG0 /100 | NG0 /100 | NG0 /100 | NG0 /100 | NG 0 /100 |
| Samples having a small plating thickness on inner surface | NG80 /100 | NG80 /100 | NG80 /100 | NG80 /100 | NG60 /100 | NG50 /100 | NG0 /100 | NG0 /100 |

Samples having a large plating thickness on inner surface
(1) Plating thickness
- Plating thickness on outer surface of hexagonal portion: 5 μm
- Ni plating thickness on inner surface on back side of groove portion lower end: 0.3 μm (2) Sample preparing conditions
- Ni plating time: 40 min
- Current density: 0.45 $A/dm^2$ Samples having a small plating thickness on inner surface
(1) Plating thickness
- Plating thickness on outer surface of hexagonal portion: 5 μm
- Ni plating thickness on inner surface on back side of groove portion lower end: 0.1 μm (2) Sample preparing conditions
- Ni plating time: 15 min
- Current density: 1.2 $A/dm^2$

FIG. 13

(8) Effect of height of groove portion
- Test method: stress corrosion cracking resistance evaluation test
  (judgment by elapsed time before cracking in groove portion)
- Plating specifications: Ni strike plating + Ni plating + electrolytic trivalent chromate + rust prevention oil

| | Evaluation | | | | |
|---|---|---|---|---|---|
| Height of groove portion (mm) | 3 | 3.5 | 5 | 6.5 | 7 |
| Samples having a large plating thickness on inner surface | A | A | A | A | C |
| Samples having a small plating thickness on inner surface | F | FF | FF | FF | FF |

Samples having a large plating thickness on inner surface
(1) Plating thickness
- Plating thickness on outer surface of hexagonal portion: 5 μm
- Ni plating thickness on inner surface on back side of groove portion lower end: 0.3 μm (2) Sample preparing conditions
- Ni plating time: 40 min
- Current density: 0.45 A/dm$^2$ Samples having a small plating thickness on inner surface
(1) Plating thickness
- Plating thickness on outer surface of hexagonal portion: 5 μm
- Ni plating thickness on inner surface on back side of groove portion lower end: 0.1 μm (2) Sample preparing conditions
- Ni plating time: 15 min
- Current density: 1.2 A/dm$^2$

[Criteria]
- Stress corrosion cracking resistance
  (Judgment by elapsed time before cracking in groove portion)
  - A: 80-100 hrs
  - B: 50-80 hrs
  - C: 20-50 hrs
  - F: 10-20 hrs
  - FF: 10 hrs or less

SPARK PLUG HAVING STRESS CORROSION CRACKING RESISTANCE

FIELD OF THE INVENTION

The present invention relates to a spark plug for an internal combustion engine.

BACKGROUND OF THE INVENTION

A spark plug for providing ignition in an internal combustion engine, such as a gasoline engine, has the following structure: an insulator is provided externally of a center electrode; a metallic shell is provided externally of the insulator; and a ground electrode which forms a spark discharge gap in cooperation with the center electrode is attached to the metallic shell. The metallic shell is generally formed from an iron-based material, such as carbon steel, and, in many cases, plating is performed on its surface for corrosion protection. A known technique associated with such a plating layer employs a 2-layer structure consisting of an Ni plating layer and a chromate layer (See Japanese Patent Application Laid-Open (kokai) No. 2002-184552). However, the inventors of the present invention have found that, even in employment of a plating layer having such a two- or more-layer structure, corrosion resistance is still a big problem for a portion of a spark plug which is deformed at the time of crimping. The following description first discusses an example structure of a spark plug and a crimping step, and then a portion of the spark plug which is deformed from crimping and involves a problem with respect to corrosion resistance.

FIG. 1 is a sectional view of essential members, showing an example structure of a spark plug. A spark plug 100 includes a tubular metallic shell 1; a tubular insulator 2 (ceramic insulator), which is fitted into the metallic shell 1 in such a manner that its forward end portion projects from the metallic shell 1; a center electrode 3, which is provided in the insulator 2 in such a state that its forward end portion projects from the insulator 2; and a ground electrode 4, whose one end is joined to the metallic shell 1 and whose other end faces the forward end of the center electrode 3. A spark discharge gap g is formed between the ground electrode 4 and the center electrode 3.

The insulator 2 is formed from, for example, a ceramic sintered body of alumina or aluminum nitride and has a through hole 6 formed therein in such a manner as to extend along the axial direction thereof, and adapted to allow the center electrode 3 to be fitted therein. A metal terminal 13 is fixedly inserted into the through hole 6 at a side toward one end of the through hole 6, whereas the center electrode 3 is fixedly inserted into the through hole 6 at a side toward the other end of the through hole 6. A resistor 15 is disposed, within the through hole 6, between the metal terminal 13 and the center electrode 3. Opposite end portions of the resistor 15 are electrically connected to the center electrode 3 and the metal terminal 13 via electrically conductive glass seal layers 16 and 17, respectively.

The metallic shell 1 is formed into a hollow, cylindrical shape from a metal, such as carbon steel, and forms a housing of the spark plug 100. The metallic shell 1 has a threaded portion 7 formed on its outer circumferential surface and adapted to mount the spark plug 100 to an unillustrated engine block. A hexagonal portion 1*e* is a tool engagement portion which allows a tool, such as a spanner or a wrench, to be engaged therewith in mounting the metallic shell 1 to the engine block, and has a hexagonal cross section. The tool engagement portion may have any cross-sectional shape (orthogonal-to-axis sectional shape) other than a hexagonal shape; for example, the tool engagement portion may have another polygonal cross section, such as an octagonal cross section. In a space between the outer surface of the insulator 2 and the inner surface of a rear (upper in the drawing) opening portion of the metallic shell 1, a ring packing 62 is disposed on the rear periphery of a flange-like projection 2*e* of the insulator 2, and a filler layer 61, such as talc, and a ring packing 60 are disposed, in this order, rearward of the ring packing 62. In assembling work, the insulator 2 is pressed forward (downward in the drawing) into the metallic shell 1, and, in this condition, the rear opening end of the metallic shell 1 is crimped inward toward the ring packing 60 (and, in turn, toward the projection 2*e*, which functions as a receiving portion for crimping), whereby a crimp portion 1*d* is formed, and thus the metallic shell 1 is fixed to the insulator 2.

A gasket 30 is fitted to a proximal end of the threaded portion 7 of the metallic shell 1. The gasket 30 is formed by bending a metal sheet of carbon steel or the like into the form of a ring. When the threaded portion 7 is screwed into a threaded hole of the cylinder head, the gasket 30 is compressed in the axial direction and deformed in a crushed manner between a flange-like gas seal portion 1*f* f of the metallic shell 1 and a peripheral-portion-around-opening of the threaded hole, thereby sealing the gap between the threaded hole and the threaded portion 7.

FIG. 2 is an explanatory view showing an example step of fixing the metallic shell 1 to the insulator 2 through crimping (FIG. 2 omits the illustration of the ground electrode 4). First, as shown in FIG. 2(*b*), the insulator 2 whose through hole 6 accommodates the center electrode 3, the electrically conductive glass seal layers 16 and 17, the resistor 15, and the metal terminal 13 is inserted into the metallic shell 1 shown in FIG. 2(*a*) from an insertion opening portion 1*p* (where a prospective crimp portion 200 which is to become the crimp portion 1*d* is formed) at the rear end of the metallic shell 1, thereby establishing a state in which an engagement portion 2*h* of the insulator 2 and an engagement portion 1*c* of the metallic shell 1 are engaged together via a sheet packing 63.

Then, as shown in FIG. 2(*c*), the ring packing 62 is disposed inside the metallic shell 1 through the insertion opening portion 1*p*; subsequently, the filler layer 61 of talc or the like is formed; and, furthermore, the ring packing 60 is disposed. Then, by means of a crimping die 111, the prospective crimp portion 200 is crimped to an end surface 2*n* of the projection 2*e*, which functions as a receiving portion for crimping, via the ring packing 62, the filler layer 61, and the ring packing 60, thereby forming the crimp portion 1*d* and fixing the metallic shell 1 to the insulator 2 through crimping as shown in FIG. 2(*d*). At this time, in addition to the crimp portion 1*d*, a groove portion 1*h* (FIG. 1) located between the hexagonal portion 1*e* and the gas seal portion 1*f* is also deformed under a compressive stress associated with crimping. The reason for this is that the crimp portion 1*d* and the groove portion 1*h* are thinnest portions in the metallic shell 1 and are thus readily deformable. The groove portion 1*h* is also called the "thin-walled portion." After the step of FIG. 2(*d*), the ground electrode 4 is bent toward the center electrode 3 so as to form the spark discharge gap g, thereby completing the spark plug 100 of FIG. 1. The crimping step described with reference to FIG. 2 is of cold crimping (See Japanese Patent Application Laid-Open (kokai) No. 2007-141868); however, hot crimping (See Japanese Patent Application Laid-Open (kokai) No. 2003-257583) can also be employed.

SUMMARY OF THE INVENTION

According to the above-mentioned conventional technique (See Japanese Patent Application Laid-Open (kokai) No.

2002-184552), an electrolytic chromating process is performed such that 95% by mass or more of the chromium component of a chromate layer is trivalent chromium. The purpose of such chromating is to reduce environmental burden through attainment of substantially zero content of hexavalent chromium and to improve corrosion resistance against salt water (salt corrosion resistance).

However, as mentioned above, crimping causes the crimp portion 1*d* and the groove portion 1*h* to be greatly deformed, resulting in the generation of a large residual stress in these portions; therefore, corrosion resistance is a big problem for these portions. That is, the crimp portion 1*d* and the groove portion 1*h* are characterized by the presence of a large residual stress caused by crimping-induced deformation. Particularly, in the case of employment of hot crimping, hardness increases as a result of a change of microstructure associated with application of heat. A portion which has such high hardness and in which a large residual stress exists may suffer stress corrosion cracking. The inventors of the present invention have found that, particularly in a spark plug, not only salt corrosion resistance, but also stress corrosion cracking resistance is a big problem to consider for the crimp portion 1*d* and the groove portion 1*h*. Such a problem to consider is particularly marked in a case of using the metallic shell formed from a material having a high content of carbon (e.g., carbon steel which contains carbon in an amount of 0.15% by weight or more). Such a problem to consider is also marked in the case of employing hot crimping.

Conventionally employed nickel plating specifications give importance to corrosion resistance of the outer surface of the metallic shell and tend to not give much importance to the plating thickness of the inner surface. However, since the inner surface of the metallic shell is in a closed space, dew condensation is apt to occur thereon upon exposure to coldness. Also, since the inner surface is thin in plating thickness as compared with the outer surface, the occurrence of stress corrosion cracking associated with progress of corrosion is more concerned. In view of these findings and consideration, the inventors of the present invention have reached the understanding that it is important to design the plating thickness of the inner surface of the metallic shell to restrain stress corrosion cracking, and thus have conceived the present invention.

Generally, if a plating thickness of the same level is ensured for the inner and outer surfaces of the metallic shell (if the inner surface can be coated with sufficiently thick plating), sufficient stress corrosion cracking resistance conceivably can be ensured. However, in actuality, the following has been found: when plating on the inner surface is excessively thick, crimping-induced deformation causes cracking to occur in the plating on the inner surface, resulting in deterioration in stress corrosion cracking resistance. Therefore, importantly, the plating thickness of the inner surface must fall within such an appropriate range as not to lead to the occurrence of cracking after crimping. That is, in designing nickel plating on the metallic shell, preferably, the nickel plating thickness of the inner surface is determined so as to be appropriate to stress corrosion cracking resistance. Particularly, desirably, the nickel plating thickness of the outer surface and the nickel plating thickness of the inner surface are specified in such a balanced manner that the nickel plating thickness of the outer surface is appropriate to corrosion resistance, whereas the nickel plating thickness of the inner surface is appropriate to stress corrosion cracking resistance.

An object of the present invention is to provide a spark plug to which excellent stress corrosion cracking resistance is imparted by means of appropriately specifying the nickel plating thickness of the inner surface of the metallic shell.

The present invention has been conceived to solve, at least partially, the above problems and can be embodied in the following modes or application examples.

Application example 1 A spark plug comprising:
- a tubular ceramic insulator having an axial bore extending therethrough in an axial direction;
- a center electrode disposed at a forward end portion of the axial bore; and
- a metallic shell provided around the ceramic insulator;

the spark plug being characterized in that:
- the metallic shell has:
  - a tool engagement portion projecting outward and having a polygonal orthogonal-to-axis sectional shape;
  - a gas seal portion projecting outward; and
  - a groove portion formed between the tool engagement portion and the gas seal portion and having an orthogonal-to-axis sectional area of 36 $mm^2$ or less;
- the metallic shell is covered with a nickel plating layer; and
- as measured at a forward end of an inner circumferential surface of the groove portion, the nickel plating layer has a thickness of 0.3 μm to 2.0 μm.

Application example 2 A spark plug comprising:
- a tubular ceramic insulator having an axial bore extending therethrough in an axial direction;
- a center electrode disposed at a forward end portion of the axial bore; and
- a metallic shell provided around the ceramic insulator;

the spark plug being characterized in that:
- the metallic shell has:
  - a tool engagement portion projecting outward and having a polygonal orthogonal-to-axis sectional shape;
  - a gas seal portion projecting outward; and
  - a groove portion formed between the tool engagement portion and the gas seal portion and having an orthogonal-to-axis sectional area of 36 $mm^2$ or less;
- the metallic shell is covered with a nickel plating layer and has a chromium-containing layer formed on the nickel plating layer; and
- as measured at a forward end of an inner circumferential surface of the groove portion, the nickel plating layer has a thickness of 0.2 μm to 2.2 μm.

Application example 3 A spark plug comprising:
- a tubular ceramic insulator having an axial bore extending therethrough in an axial direction;
- a center electrode disposed at a forward end portion of the axial bore; and
- a metallic shell provided around the ceramic insulator;

the spark plug being characterized in that:
- the metallic shell has:
  - a tool engagement portion projecting outward and having a polygonal orthogonal-to-axis sectional shape;
  - a gas seal portion projecting outward; and
  - a groove portion formed between the tool engagement portion and the gas seal portion and having an orthogonal-to-axis sectional area of 36 $mm^2$ or less;
- the metallic shell is covered with a nickel plating layer and has rust prevention oil applied onto the nickel plating layer; and
- as measured at a forward end of an inner circumferential surface of the groove portion, the nickel plating layer has a thickness of 0.2 μm to 2.2 μm.

Application example 4 A spark plug comprising:
- a tubular ceramic insulator having an axial bore extending therethrough in an axial direction;
- a center electrode disposed at a forward end portion of the axial bore; and
- a metallic shell provided around the ceramic insulator;

the spark plug being characterized in that:

the metallic shell has:

a tool engagement portion projecting outward and having a polygonal orthogonal-to-axis sectional shape;

a gas seal portion projecting outward; and a groove portion formed between the tool engagement portion and the gas seal portion and having an orthogonal-to-axis sectional area of 36 $mm^2$ or less;

the metallic shell is covered with a nickel plating layer and has a chromium-containing layer formed on the nickel plating layer, and rust prevention oil applied onto the chromium-containing layer; and as measured at a forward end of an inner circumferential surface of the groove portion, the nickel plating layer has a thickness of 0.1 μm to 2.4 μm.

Application example 5 A spark plug according to any one of application examples 1 to 4, wherein, as measured on an outer surface of the tool engagement portion, the nickel plating layer has a thickness of 3 μm to 15 μm.

Application example 6 A spark plug according to any one of application examples 1 to 5, wherein the metallic shell and an insulator accommodated in the metallic shell are fitted together by hot crimping.

Application example 7 A spark plug according to any one of application examples 1 to 6, wherein the groove portion has a height of 3.5 mm to 6.5 mm as measured in the axial direction.

The present invention can be embodied in various forms. For example, the present invention can be embodied in a spark plug, a metallic shell for the spark plug, a method of manufacturing the spark plug, and a method of manufacturing the metallic shell.

The configuration of application example 1 can provide a spark plug having excellent stress corrosion cracking resistance by means of employing a nickel plating layer thickness of 0.3 μm to 2.0 μm as measured at the forward end of the inner circumferential surface of the groove portion of the metallic shell.

The configuration of application example 2 can provide a spark plug having excellent stress corrosion cracking resistance in the case where the chromium-containing layer is formed on the nickel plating layer of the metallic shell, by means of employing a nickel plating layer thickness of 0.2 μm to 2.2 μm as measured at the forward end of the inner circumferential surface of the groove portion of the metallic shell.

The configuration of application example 3 can provide a spark plug having excellent stress corrosion cracking resistance in the case where rust prevention oil is applied onto the nickel plating layer of the metallic shell, by means of employing a nickel plating layer thickness of 0.2 μm to 2.2 μm as measured at the forward end of the inner circumferential surface of the groove portion of the metallic shell.

The configuration of application example 4 can provide a spark plug having excellent stress corrosion cracking resistance in the case where the chromium-containing layer is formed on the nickel plating layer of the metallic shell, and rust prevention oil is applied onto the chromium-containing layer, by means of employing a nickel plating layer thickness of 0.1 μm to 2.4 μm as measured at the forward end of the inner circumferential surface of the groove portion of the metallic shell.

The configuration of application example 5 can provide a spark plug having not only excellent stress corrosion cracking resistance but also excellent corrosion resistance (salt corrosion resistance) and plating peeling resistance.

The configuration of application example 6 can provide a spark plug having excellent stress corrosion cracking resistance even in the case where hot-crimping-induced deformation puts stress corrosion cracking resistance at stake, by means of employing a nickel plating layer thickness in the above-mentioned appropriate ranges as measured at the forward end of the inner circumferential surface of the metallic shell.

Generally, as the opposite side-to-side dimension of the tool engagement portion (for example, the distance between opposite sides of the hexagonal portion) reduces (for example, 14 mm or less), the height (length in the axial direction) of the groove portion must be increased in order to ensure gastightness. This is for the following reason: increasing the height of the groove portion allows an increase in the amount of deformation of the groove portion at the time of crimping, whereby fixation can be further enhanced. According to the configuration of application example 7, the height of the groove portion is 3.5 mm or more; thus, the amount of deformation of the groove portion is increased. Accordingly, stress corrosion cracking is more likely to occur; therefore, the effect of the present invention of preventing stress corrosion cracking is more markedly produced. Meanwhile, when the height of the groove portion is in excess of 6.5 mm, the deformation of the groove portion is excessively increased; therefore, the effect of preventing stress corrosion cracking is limited.

BRIEF DESCRIPTION OF THE DRAWINGS

FIG. 4 is an explanatory view showing the results of an experiment on the effect of the Ni plating thickness of the inner surface of a groove portion of the metallic shell on stress corrosion cracking resistance of the metallic shell in the case where an Ni strike plating process and an Ni plating process are performed.

FIG. 6 is an explanatory view showing the results of an experiment on the effect of the Ni plating thickness of the inner surface of the groove portion of the metallic shell on stress corrosion cracking resistance of the metallic shell in the case where the Ni strike plating process, the Ni plating process, and an electrolytic chromating process are performed.

FIG. 7 is an explanatory view showing the results of an experiment on the effect of the Ni plating thickness of the inner surface of the groove portion of the metallic shell on stress corrosion cracking resistance of the metallic shell in the case where the Ni strike plating process, the Ni plating process, and application of rust prevention oil are performed.

FIG. 8 is an explanatory view showing the results of an experiment on the effect of the Ni plating thickness of the inner surface of the groove portion of the metallic shell on stress corrosion cracking resistance of the metallic shell in the case where the Ni strike plating process, the Ni plating process, the electrolytic chromating process, and application of rust prevention oil are performed.

FIG. 9 is an explanatory view showing the results of an experiment on the effect of the Ni plating thickness of an outer surface on corrosion resistance and plating peeling resistance, the experiment being conducted by varying the Ni plating thickness.

FIG. 10 is an explanatory view showing the results of an experiment on the effect of the Ni plating thickness of the outer surface on corrosion resistance and plating peeling resistance, the experiment being conducted by varying the Ni plating thickness.

FIG. 11 is an explanatory view showing the results of an experiment on the effect of whether or not the Ni strike plating process is provided, on stress corrosion cracking resistance.

FIG. 12 is an explanatory view showing the results of an experiment on the effect of the cross-sectional area of the groove portion of the metallic shell on stress corrosion cracking resistance.

FIG. 13 is an explanatory view showing the results of an experiment on the effect of the height of the groove portion of the metallic shell on stress corrosion cracking resistance.

DETAILED DESCRIPTION OF PREFERRED EMBODIMENTS

Figure 1:
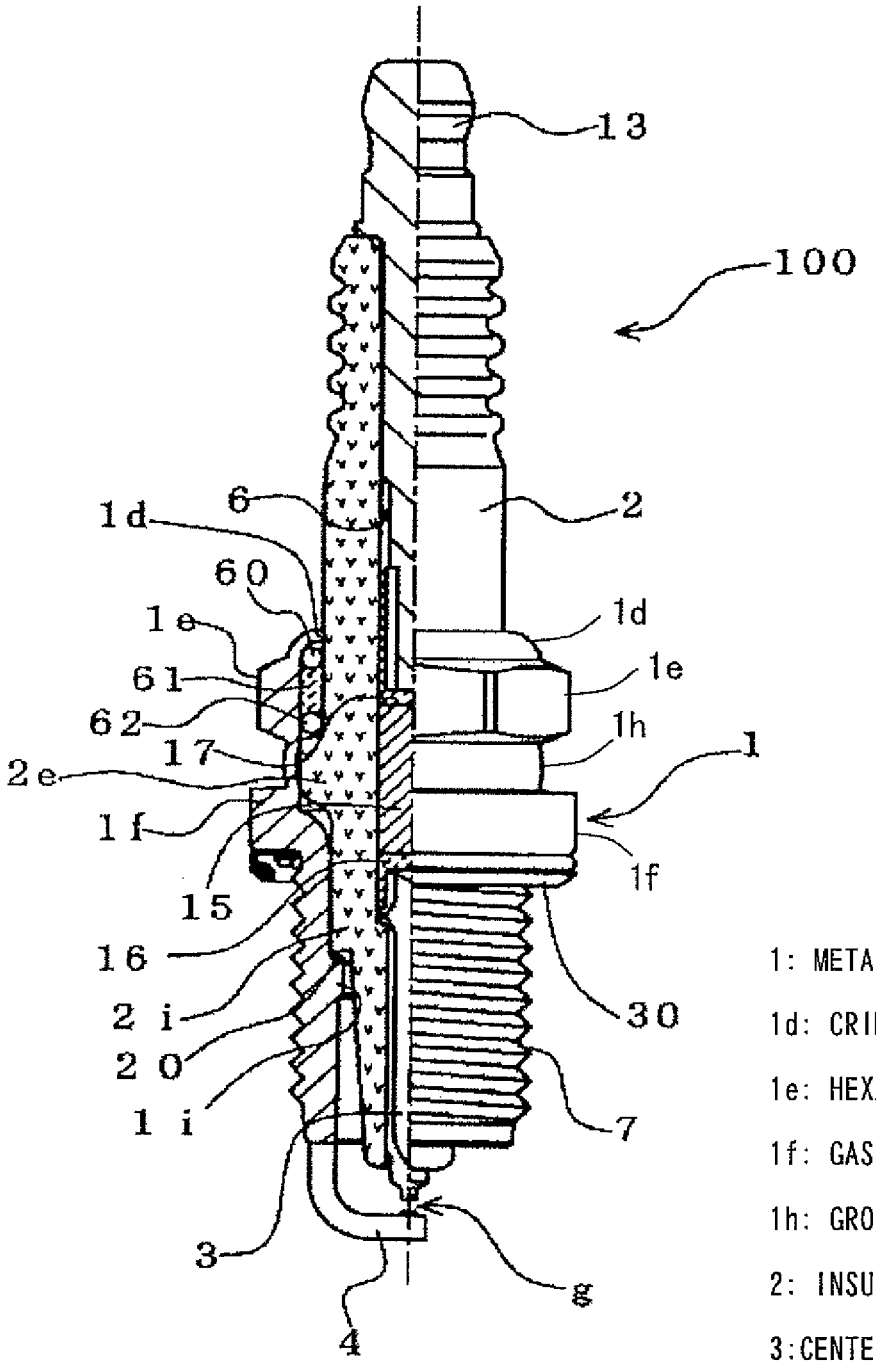
FIG. 1 is a sectional view of essential members, showing an example structure of a spark plug.
Figures 2A, 2B, 2C, 2D:
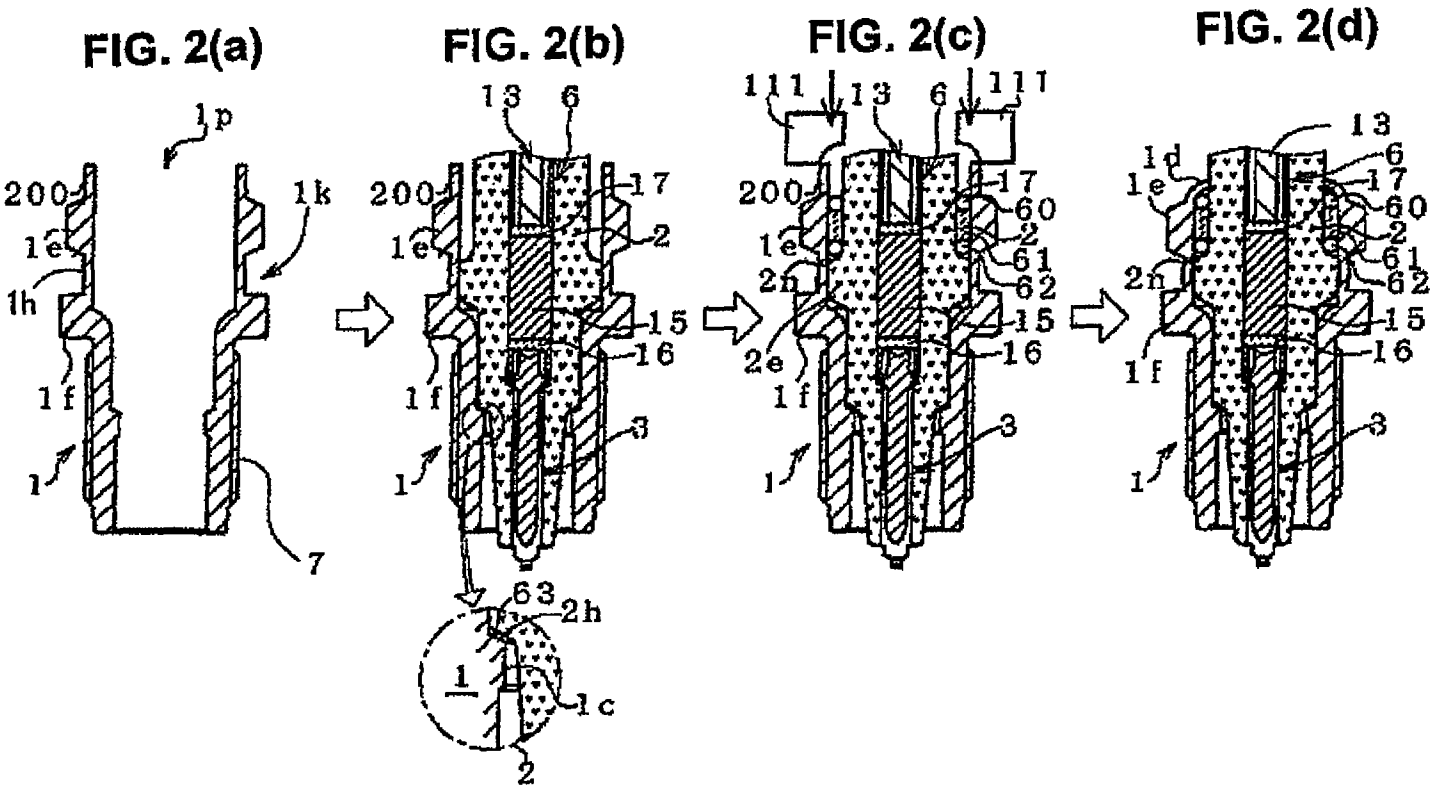
FIGS. 2(*a*)-2(*d*) are explanatory views showing an example crimping step of fixing a metallic shell to an insulator.

A spark plug according to an embodiment of the present invention has the configuration shown in FIG. 1. Since this configuration has been described above, repeated description thereof is omitted. A spark plug 100 is manufactured, for example, by fixing a metallic shell 1 and an insulator 2 to each other according to the crimping step shown in FIG. 2. Before the crimping step, a plating process is performed on the metallic shell 1.

Figure 3:
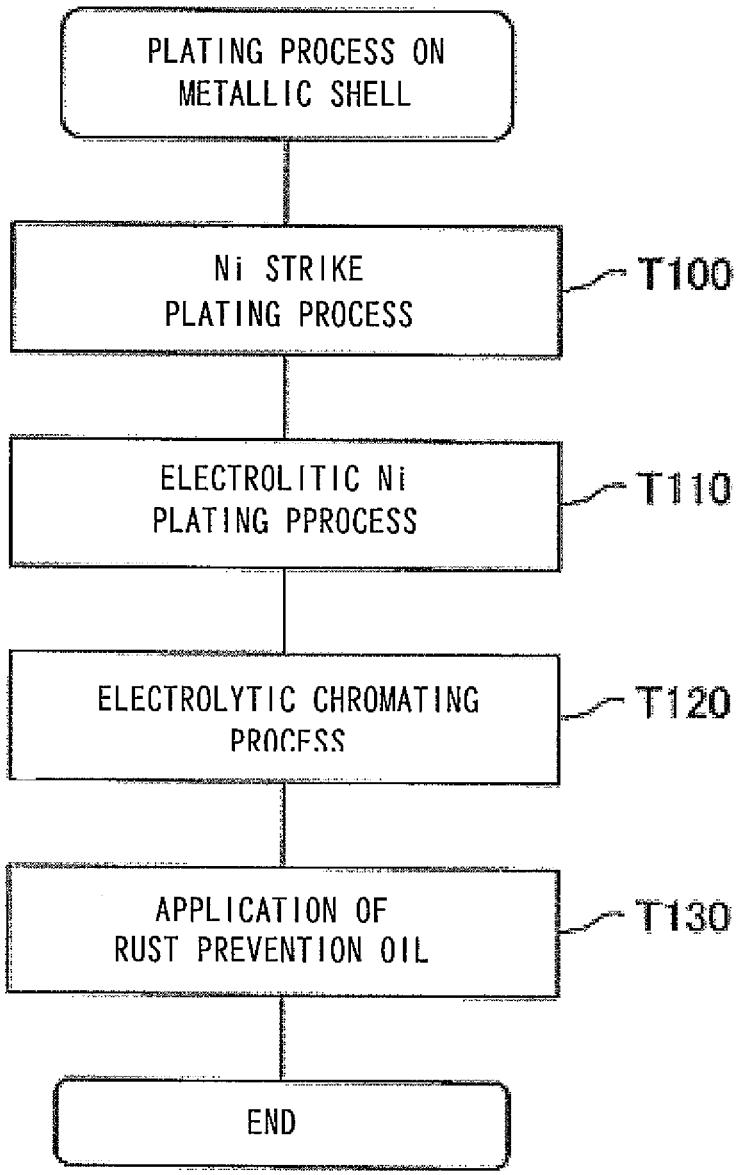
FIG. 3 is a flowchart showing the procedure of a plating process to be performed on the metallic shell.

FIG. 3 is a flowchart showing the procedure of a plating process to be performed on the metallic shell. In step T100, if necessary, nickel strike plating is performed. Nickel strike plating is performed for cleaning the surface of the metallic shell formed from carbon steel and for improving adhesion between plating and a base metal. However, nickel strike plating may be omitted. Usually employed processing conditions can be employed for nickel strike plating. A specific example of preferable processing conditions is as follows.

Example of Processing Conditions of Nickel Strike Plating

Composition of plating bath

Nickel chloride: 150-600 g/L

35% hydrochloric acid: 50-300 ml/L

Solvent: Deionized water

Processing temperature (bath temperature): 25-40° C.

Cathode current density: 0.2-0.4 A/dm$^2$

Processing time: 5-20 minutes

In step T110, an electrolytic nickel plating process is performed. The electrolytic nickel plating process can be a barrel-type electrolytic nickel plating process which uses a rotary barrel, and may employ another plating method, such as a stationary plating method. Usually employed processing conditions can be employed for electrolytic nickel plating. A specific example of preferable processing conditions is as follows.

Example of Processing Conditions of Electrolytic Nickel Plating

Composition of plating bath

Nickel sulfate: 100-400 g/L

Nickel chloride: 20-60 g/L

Boric acid: 20-60 g/L

Solvent: Deionized water

Bath pH: 2.0-4.8

Processing temperature (bath temperature): 25-60° C.

Cathode current density: 0.02-3.0 A/dm$^2$

Processing time: 5-600 minutes

The lower the cathode current density, the smaller the difference in Ni plating layer thickness between the outer surface and the inner surface of the metallic shell, and, the higher the cathode current density, the larger the difference. Meanwhile, the longer the processing time, the greater the Ni plating layer thickness. Therefore, the balance of the Ni plating layer thickness between the outer surface and the inner surface of the metallic shell can be adjusted by adjusting a combination of the cathode current density and the processing time.

In step T120, if necessary, an electrolytic chromating process is performed, thereby forming a chromate layer (also called the "chromium-containing layer"). The electrolytic chromating process can also use a rotary barrel and may employ another plating method, such as a stationary plating method. An example of preferable processing conditions of the electrolytic chromating process is as follows.

Example of Processing Conditions of Electrolytic Chromating Process

Composition of processing bath (chromating processing solution)

Sodium dichromate: 20-70 g/L

Solvent: Deionized water

Bath pH: 2-6

Processing temperature (bath temperature): 20-60° C.

Cathode current density: 0.02-0.45 A/dm$^2$

Processing time: 1-10 minutes

A usable dichromate other than sodium dichromate is potassium dichromate. Another combination of processing conditions (amount of dichromate, cathode current density, processing time, etc.) different from the above may be employed according to a desired thickness of the chromate layer. This electrolytic chromating process is an electrolytic trivalent chromating process in which the chromium component in the chromate layer is trivalent chromium. Preferable processing conditions of the chromating process will be described later together with experimental results.

When the Ni plating process and the electrolytic chromating process are performed, a film of 2-layer structure consisting of the nickel plating layer and the chromate layer is formed on the outer and inner surfaces of the metallic shell. However, the electrolytic chromating process can be omitted. Also, still another protection film may be formed on the 2-layer structure consisting of the nickel plating layer and the chromate layer.

In step T130, if necessary, rust prevention oil is applied as a protection film. Commercially available various rust prevention oils can be used. Rust prevention oil can be applied, for example, by immersing the entire metallic shell in rust prevention oil. Usable rust prevention oil contains at least one of C (mineral oil), Ba, Ca, Na, and S. If the Ba content is excessively high, the appearance of the metallic shell may discolor. As for the components other than Ba, if their contents are excessively low, corrosion resistance may deteriorate, and, if their contents are excessively high, nonuniform color tone or discoloration may occur after application of rust prevention oil. Application of rust prevention oil can be omitted.

After various protection films are formed as mentioned above, the metallic shell is fixed to the insulator, etc., by the crimping step, thereby completing the spark plug. In addition to cold crimping, hot crimping can also be used in the crimping step.

EXAMPLES

(1) First Example (Ni Strike Plating+Ni Plating)

In the first example, there were manufactured a plurality of metallic shell samples which differed in the Ni plating thickness of the inner surface by executing step T100 (Ni strike plating process) and step T110 (electrolytic Ni plating process) of FIG. 3 while omitting step S120 (electrolytic chromating process) and step T130 (application of rust prevention oil) of FIG. 3. These metallic shells were subjected to a stress corrosion cracking resistance evaluation test.

First, the metallic shells 1 were manufactured, by cold forging, from a carbon steel wire SWCH17K for cold forging specified in JIS G3539. The ground electrodes 4 were welded to the respective metallic shells 1, followed by degreasing and water washing. Subsequently, a nickel strike plating process was performed under the following processing conditions by use of a rotary barrel.

Processing Conditions of Nickel Strike Plating
Composition of plating bath
Nickel chloride: 300 g/L
35% hydrochloric acid: 100 ml/L
Processing temperature (bath temperature): 30° C.
Cathode current density: 0.3 A/dm$^2$
Processing time: 15 minutes Next, an electrolytic nickel plating process was performed under the following processing conditions by use of the rotary barrel, thereby forming nickel plating layers.

Figure 5:
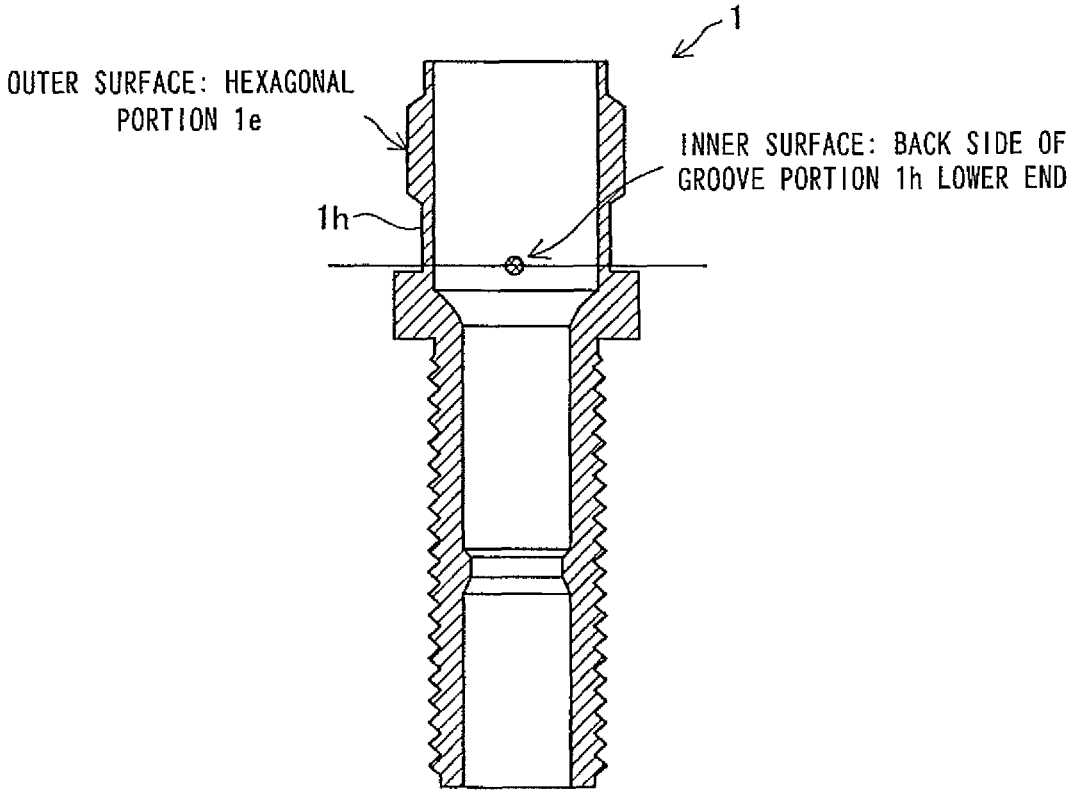
FIG. 5 is a sectional view of the metallic shell, showing the position of measuring the plating thickness.

Processing Conditions of Electrolytic Nickel Plating
Composition of plating bath
Nickel sulfate: 250 g/L
Nickel chloride: 50 g/L
Boric acid: 40 g/L
Bath pH: 4.0
Processing temperature (bath temperature): 55° C.
Cathode current density: 0.03-2.4 A/dm$^2$
Processing time: 5-600 minutes FIG. 4 is an explanatory view showing the processing conditions (processing time and cathode current density) of the Ni plating process, the Ni plating thickness, and the results of the stress corrosion cracking resistance test, with respect to samples S101 to S113 prepared by the above-mentioned processing. FIG. 5 shows the position of measuring the Ni plating thickness. The groove portions 1*h* of the samples S101 to S113 had a horizontal sectional area (hereinafter, called the "cross-sectional area" or the "orthogonal-to-axis sectional area") of 28 mm$^2$. The cross-sectional area of the groove portion 1*h* is the area of an annular section of the groove portion 1*h* as cut along the horizontal direction in FIG. 5. In measurement of the plating thickness, each of the samples was cut by a plane which contained the axis; then, the Ni plating thickness was measured on the outer surface of the hexagonal portion 1*e* and on the inner surface of the lower end of the groove portion 1*h* (at the forward end of the inner circumferential surface of the groove portion 1*h*) by use of a fluorescent X-ray film thickness meter. The Ni plating thickness on the outer surface of the hexagonal portion 1*e* was fixed to about 5 μm with respect to all of the samples S101 to S113.

We can read, from FIG. 4, the effect of the Ni plating thickness of the inner surface of the groove portion 1*h* on stress corrosion cracking resistance in the case where an Ni strike plating process and an Ni plating process are performed. In the samples S101 to S113, in order to vary the plating thickness on the inner surface of the groove portion 1*h* while the plating thickness on the outer surface of the hexagonal portion 1*e* was held at a fixed value, the processing time of the Ni plating process was varied in a range of 7.5 minutes to 555 minutes, and the cathode current density was varied in a range of 2.4 A/dm$^2$ to 0.032 A/dm$^2$. As a result, the plating thickness on the inner surface of the groove portion 1*h* was able to be varied in a range of 0.05 μm to 2.5 μm. These samples S101 to S113 were subjected to the following test for evaluating stress corrosion cracking resistance.

In order to evaluate stress corrosion cracking resistance, the following accelerated corrosion test was conducted. Four holes each having a diameter of about 2 mm were cut in the groove portions 1*h* of the samples (metallic shells); subsequently, the insulators, etc., were fixed by crimping. The holes were cut for allowing entry of a corrosive solution for test into the metallic shells. The test conditions of the accelerated corrosion test are as follows.

Test Conditions of Accelerated Corrosion Test (Stress Corrosion Cracking Resistance Evaluation Test)
Composition of corrosive solution
Calcium nitrate tetrahydrate: 1,036 g
Ammonium nitrate: 36 g
Potassium permanganate: 12 g
Pure water: 116 g
pH: 3.5-4.5
Processing temperature: 30±10° C.

The reason for adding potassium permanganate as an oxidizer into the corrosive solution is to accelerate the corrosion test.

After the 10-hour test under the above-mentioned test conditions, the samples were taken out from the corrosive solution. Then, the groove portions 1*h* of the samples were externally examined by use of a magnifier to see if cracking was generated in the groove portions 1*h*. When the samples were found to be free from cracking, the corrosive solution was replaced with a new one; then, the samples underwent the accelerated corrosion test under the same conditions for another 10 hours. The test was repeated until the cumulative test time reached 80 hours. As a result of the crimping step, a large residual stress is generated in the groove portions 1*h*. Therefore, by means of the accelerated corrosion test, the groove portions 1*h* can be evaluated for stress corrosion cracking resistance. In the samples S101 to S103 and S109 to S113, cracking occurred in the groove portions 1*h* at a cumulative test time of 20 hours or less. In the samples S104, S107, and S108, cracking occurred in the groove portions 1*h* at a cumulative test time of in excess of 20 hours to less than 50 hours. In the samples S105 and S106, the groove portions 1*h* were free from cracking even when the cumulative test time reached 80 hours. Thus, the following is understandable: in the case where the Ni strike plating process and the Ni plating process are performed, while the electrolytic chromating process and application of rust prevention oil are not performed, in view of stress corrosion cracking resistance, the Ni plating layer thickness on the inner surface of the metallic shell is preferably 0.3 μm to 2.0 μm, more preferably 0.4 μm to 1.8 μm.

(2) Second Example (Ni Strike Plating+Ni Plating+Electrolytic Chromating)

In the second example, metallic shells were manufactured by executing step T100 (Ni strike plating process), step T110 (electrolytic Ni plating process), and step T120 (electrolytic chromating process) of FIG. 3 while omitting step T130 (application of rust prevention oil) of FIG. 3. The manufactured metallic shells were subjected to the stress corrosion cracking resistance evaluation test. Processing conditions of steps T100 and T110 were similar to those of the first example. The electrolytic chromating process of step T120 was performed by use of a rotary barrel under the following processing conditions, thereby forming a chromate layer on the nickel plating layer.

Processing Conditions of Electrolytic Chromating Process

Composition of processing bath (chromating processing solution)

Sodium dichromate: 40 g/L

Solvent: Deionized water

Processing temperature (bath temperature): 35° C.

Cathode current density: 0.2 A/dm$^2$

Processing time: 5 minutes

FIG. 6 is an explanatory view showing the processing conditions (processing time and cathode current density) of the Ni plating process, the Ni plating thickness, and the results of the stress corrosion cracking resistance test, with respect to samples S201 to S213 prepared by the above-mentioned processing. The groove portions 1*h* of the samples S201 to S213 had a cross-sectional area of 28 mm$^2$. Also, the Ni plating thickness on the outer surface of the hexagonal portion 1*e* was fixed to about 5 μm with respect to all of the samples S201 to S213.

Also in the second example, similar to the first example, in order to vary the plating thickness on the inner surface of the groove portion 1*h* while the plating thickness on the outer surface of the hexagonal portion 1*e* was held at a fixed value, the processing time of the Ni plating process was varied in a range of 7.5 minutes to 555 minutes, and the cathode current density was varied in a range of 2.4 A/dm$^2$ to 0.032 A/dm$^2$. As a result, the plating thickness on the inner surface of the groove portion 1*h* was able to be varied in a range of 0.05 μm to 2.5 μm. These samples S201 to S213 were subjected to the above-mentioned test for evaluating stress corrosion cracking resistance.

As shown in FIG. 6, in the samples S201, S202, and S211 to S213, cracking occurred in the groove portions 1*h* at a cumulative test time of 20 hours or less. In the samples S203, S209, and S210, cracking occurred in the groove portions 1*h* at a cumulative test time of in excess of 20 hours to less than 50 hours. In the samples S204 to S208, the groove portions 1*h* were free from cracking even when the cumulative test time reached 80 hours. Thus, the following is understandable: in the case where the Ni strike plating process, the Ni plating process, and the electrolytic chromating process are performed, while application of rust prevention oil is not performed, in view of stress corrosion cracking resistance, the Ni plating layer thickness on the inner surface of the metallic shell is preferably 0.2 μm to 2.2 μm, and more preferably 0.3 μm to 2.0 μm. Notably, in the second example, as compared with the first example, the preferable Ni plating thickness range is slightly wider. Conceivably, this is for the following reason: in the second example, the chromate layer formed by the electrolytic chromating process contributes to improvement of stress corrosion cracking resistance.

(3) Third Example (Ni Strike Plating+Ni Plating+Rust Prevention Oil)

In the third example, metallic shells were manufactured by executing step T100 (Ni strike plating process), step T110 (electrolytic Ni plating process), and step T130 (application of rust prevention oil) of FIG. 3 while omitting step T120 (electrolytic chromating process) of FIG. 3. The manufactured metallic shells were subjected to the stress corrosion cracking resistance evaluation test. Processing conditions of steps T100 and T110 were similar to those of the first example. In step T130, rust prevention oil was applied by immersing the metallic shells in rust prevention oil for 10 seconds.

FIG. 7 is an explanatory view showing the processing conditions (processing time and cathode current density) of the Ni plating process, the Ni plating thickness, and the results of the stress corrosion cracking resistance test, with respect to samples S301 to S313 prepared by the above-mentioned processing. The groove portions 1*h* of the samples S301 to S313 had a cross-sectional area of 28 mm$^2$. Also, the Ni plating thickness on the outer surface of the hexagonal portion 1*e* was fixed to about 5 μm with respect to all of the samples S301 to S313.

Also in the third example, similar to the first and second examples, in order to vary the plating thickness on the inner surface of the groove portion 1*h* while the plating thickness on the outer surface of the hexagonal portion 1*e* was held at a fixed value, the processing time of the Ni plating process was varied in a range of 7.5 minutes to 555 minutes, and the cathode current density was varied in a range of 2.4 A/dm$^2$ to 0.032 A/dm$^2$. As a result, the plating thickness on the inner surface of the groove portion 1*h* was able to be varied in a range of 0.05 μm to 2.5 μm. These samples S301 to S313 were subjected to the above-mentioned test for evaluating stress corrosion cracking resistance.

As shown in FIG. 7, in the samples S301, S302, and S311 to S313, cracking occurred in the groove portions 1*h* at a cumulative test time of 20 hours or less. In the samples S303, S309, and S310, cracking occurred in the groove portions 1*h* at a cumulative test time in excess of 20 hours to less than 50 hours. In the samples S304 to S308, the groove portions 1*h* were free from cracking even when the cumulative test time reached 80 hours. Thus, the following is understandable: in the case where the Ni strike plating process, the Ni plating process, and application of rust prevention oil are performed, while the electrolytic chromating process is not performed, in view of stress corrosion cracking resistance, the Ni plating layer thickness on the inner surface of the metallic shell is preferably 0.2 μm to 2.2 μm, and more preferably 0.3 μm to 2.0 μm. Notably, in the third example, as compared with the first example, the preferable Ni plating thickness range is slightly wider. Conceivably, this is for the following reason: in the third example, the layer of applied rust prevention oil contributes to improvement of stress corrosion cracking resistance.

(4) Fourth Example (Ni Strike Plating+Ni Plating+Electrolytic Chromating+Rust Prevention Oil)

In the fourth example, metallic shells were manufactured by executing all of steps T100 to T130 of FIG. 3. The manufactured metallic shells were subjected to the stress corrosion cracking resistance evaluation test. Processing conditions of steps T100 and T110 were similar to those of the first example; processing conditions of step T120 were similar to those of the second example; and processing conditions of step T130 were similar to those of the third example.

FIG. 8 is an explanatory view showing the processing conditions (processing time and cathode current density) of the Ni plating process, the Ni plating thickness, and the results of the stress corrosion cracking resistance test, with respect to samples S401 to S413 prepared by the above-mentioned processing. The groove portions 1*h* of the samples S401 to S413 had a cross-sectional area of 28 mm$^2$. Also, the Ni plating thickness on the outer surface of the hexagonal portion 1*e* was fixed to about 5 μm with respect to all of the samples S401 to S413.

Also in the fourth example, similar to the first and third examples, in order to vary the plating thickness on the inner surface of the groove portion 1*h* while the plating thickness on the outer surface of the hexagonal portion 1*e* was held at a fixed value, the processing time of the Ni plating process was varied in a range of 7.5 minutes to 555 minutes, and the cathode current density was varied in a range of 2.4 A/dm$^2$ to 0.032 A/dm$^2$. As a result, the plating thickness on the inner surface of the groove portion 1*h* was able to be varied in a range of 0.05 μm to 2.5 μm. These samples S401 to S413 were subjected to the above-mentioned test for evaluating stress corrosion cracking resistance.

As shown in FIG. 8, in the samples S401 and S413, cracking occurred in the groove portions 1*h* at a cumulative test time of 20 hours or less. In the samples S402, S411, and S412, cracking occurred in the groove portions 1*h* at a cumulative test time in excess of 20 hours to less than 50 hours. In the samples S403 to S410, the groove portions 1*h* were free from cracking even when the cumulative test time reached 80 hours. Thus, the following is understandable: in the case where all of the Ni strike plating process, the Ni plating process, the electrolytic chromating process, and application of rust prevention oil are performed, in view of stress corrosion cracking resistance, the Ni plating layer thickness on the inner surface of the metallic shell is preferably 0.1 μm to 2.4 μm, and more preferably 0.2 μm to 2.2 μm. Notably, in the fourth example, as compared with the first to third examples, the preferable Ni plating thickness range is further widened. Conceivably, this is for the following reason: in the fourth example, both of the chromate layer and the layer of applied rust prevention oil contribute to improvement of stress corrosion cracking resistance.

(5) Fifth Example (Effect of Ni Plating Thickness of Outer Surface)

In the first to fourth examples mentioned above, the plating thickness of the outer surface of the metallic shell was held at a fixed value of 5 μm; however, in the fifth example, corrosion resistance and plating peeling resistance evaluation tests were conducted for the case where the plating thickness of the outer surface of the metallic shell was varied.

FIG. 9 is an explanatory view showing the processing conditions (processing time and cathode current density) of the Ni plating process, the Ni plating thickness, and the results of the corrosion resistance and plating peeling resistance tests, with respect to the samples of the fifth example. Metallic shells were manufactured by executing step T100 (Ni strike plating process) and step T110 (electrolytic Ni plating process) in the manufacturing process of FIG. 3 while omitting step S120 (electrolytic chromating process) and step T130 (application of rust prevention oil) in the manufacturing process. Processing conditions of steps T100 and T110 were similar to those of the first example. In manufacture of samples S501 to S509, the processing time of the Ni plating process was varied in a range of 16 minutes to 160 minutes, and the cathode current density was held at a fixed value of 0.45 A/dm$^2$. As a result, the plating thickness on the outer surface of the hexagonal portion 1*e* was able to be varied in a range of 2 μm to 20 μm, and the plating thickness on the inner surface of the groove portion 1*h* was able to be held at a fixed value of about 0.3 μm. These samples S501 to S509 were subjected to the following corrosion resistance (salt corrosion resistance) and plating peeling resistance evaluation tests.

In order to evaluate corrosion resistance, the neutral salt water spray test specified in JIS H8502 was conducted. In this test, after a 48-hour salt spray test, there was measured the percentage of a red-rusted area to the surface area of the metallic shell of a sample. The percentage of a red-rusted area was calculated as follows: a sample after the test was photographed; there were measured a red-rusted area Sa in the photograph and an area Sb of the metallic shell in the photograph; and the ratio Sa/Sb was calculated, thereby obtaining a red-rusted area percentage. The sample S501 exhibited a red-rusted area percentage of in excess of 10%. The samples S502 and S503 exhibited a red-rusted area percentage of in excess of 5% to 10% or less. The sample S504 exhibited a red-rusted area percentage of in excess of 0% to 5% or less. The samples S505 to S509 were free from red rust. In the case where the Ni strike plating process and the Ni plating process are performed, while the electrolytic chromating process and application of rust prevention oil are not performed, in view of salt corrosion resistance, the Ni plating thickness of the outer surface of the metallic shell is preferably 3 μm or more, more preferably 5 μm or more, and most preferably 9 μm or more.

In the plating peeling resistance test, the insulators, etc., were fixed to the metallic shells of the samples by crimping; subsequently, the crimp portions 1*d* were inspected for a state of plating for evaluation. Specifically, there was measured the percentage of an area where lifting of plating is observed (hereinafter referred to as the "plating lifting area") to the surface area of the crimp portion 1*d*. Similar to the measurement of the red-rusted area percentage mentioned above, this measurement was performed by use of photographs. The samples S501 to S506 were free from lifting or peeling of plating, whereas the samples S507 to S509 suffered from lifting or peeling of plating. In the case where the Ni strike plating process and the Ni plating process are performed, while the electrolytic chromating process and application of rust prevention oil are not performed, in view of plating peeling resistance, preferably, the Ni plating thickness of the outer surface of the metallic shell is 15 μm or less.

From the results shown in FIG. 9, in view of both of corrosion resistance (salt corrosion resistance) and plating peeling resistance, the Ni plating thickness of the outer surface of the metallic shell is preferably a range of 3 μm to 15 μm, more preferably a range of 5 μm to 15 μm, and most preferably a range of 9 μm to 15 μm.

FIG. 10 shows the results of the corrosion resistance and plating peeling resistance evaluation tests on the metallic shells which were manufactured by executing all of steps T100 to T130 of FIG. 3. Processing conditions of steps T100 and T110 were similar to those of the first example; processing conditions of step T120 were similar to those of the second example; and processing conditions of step T130 were similar to those of the third example. In manufacture of samples S601 to S609, similar to FIG. 9, the processing time of the Ni plating process was varied in a range of 16 minutes to 160 minutes, and the cathode current density was held at a fixed value of 0.45 A/dm$^2$. As a result, the plating thickness on the outer surface of the hexagonal portion 1*e* was able to be varied in a range of 2 μm to 20 μm, and the plating thickness on the inner surface of the groove portion 1*h* was able to be held at a fixed value of about 0.3 μm. These samples S601 to S609 were subjected to the above-mentioned corrosion resistance and plating peeling resistance evaluation tests.

In the corrosion resistance test, the sample S601 exhibited a red-rusted area percentage of in excess of 10%. The sample S602 exhibited a red-rusted area percentage of in excess of 5% to 10% or less. The sample S603 exhibited a red-rusted area percentage of in excess of 0% to 5% or less. The samples S604 to S609 were free from red rust. In the case where all of the Ni strike plating process, the Ni plating process, the electrolytic chromating process, and application of rust prevention oil are performed, in view of salt corrosion resistance, the Ni plating thickness of the outer surface of the metallic shell is preferably 3 μm or more, more preferably 4 μm or more, and most preferably 5 μm or more.

In the plating peeling resistance test, the samples S601 to S606 were free from lifting or peeling of plating, whereas the samples S607 to S609 suffered from lifting or peeling of plating. Even in the case where all of the Ni strike plating process, the Ni plating process, the electrolytic chromating process, and application of rust prevention oil are performed, in view of plating peeling resistance, preferably, the Ni plating thickness of the outer surface of the metallic shell is 15 μm or less.

From the results shown in FIG. 10, in view of both of corrosion resistance and plating peeling resistance, the Ni plating thickness of the outer surface of the metallic shell is preferably 3 μm to 15 μm, more preferably 4 μm to 15 μm, and most preferably 5 μm to 15 μm.

(6) Sixth Example (Effect of Whether or Not Ni Strike Plating is Provided)

In the sixth example, the effect of whether or not the Ni strike plating process is provided, on stress corrosion cracking resistance was evaluated. FIG. 11 is an explanatory view showing the experimental results of the sixth example. The sixth example compared the case where all of the processes of steps T100 to T130 of FIG. 3 were performed, and the case where step T100 (Ni strike plating process) was omitted, while the processes of other steps T110 to T130 were performed. Processing conditions of steps T100 and T110 were similar to those of the first example; processing conditions of step T120 were similar to those of the second example; and processing conditions of step T130 were similar to those of the third example.

As shown in FIG. 11, there were tested a group of samples having a large Ni plating thickness on the inner surface of the metallic shell and a group of samples having a small Ni plating thickness on the inner surface of the metallic shell. In the group of samples having a large Ni plating thickness on the inner surface of the metallic shell, the Ni plating thickness on the outer surface of the hexagonal portion 1*e* was 5 μm, and the Ni plating thickness on the inner surface of the groove portion 1*h* was 0.3 μm. In order to attain these plating thicknesses, the Ni plating process in step T110 employed a plating time of 40 minutes and a cathode current density of 0.45 A/dm$^2$. In the group of samples having a small Ni plating thickness on the inner surface of the metallic shell, the Ni plating thickness on the outer surface of the hexagonal portion 1*e* was 5 μm, and the Ni plating thickness on the inner surface of the groove portion 1*h* was 0.1 μm. In order to attain these plating thicknesses, the Ni plating process in step T110 employed a plating time of 15 minutes and a cathode current density of 1.2 A/dm$^2$.

These two groups of samples were subjected to the above-mentioned stress corrosion cracking resistance evaluation test. In this evaluation test, after the elapse of a test time of 24 hours, 100 samples were examined for the number of samples suffering from cracking. In the group of samples having a large Ni plating thickness on the inner surface of the metallic shell, the number of samples suffering from cracking was zero regardless of whether or not the Ni strike plating process was performed. As for the group of samples having a small Ni plating thickness on the inner surface of the metallic shell, in the case where the Ni strike plating process was performed, 80 of 100 samples suffered from cracking, and, in the case where the Ni strike plating process was omitted, 95 of 100 samples suffered from cracking. These test results indicate that the Ni strike plating process somewhat improves stress corrosion cracking resistance. A conceivable reason for improvement of stress corrosion cracking resistance is that the Ni strike plating process fills pinholes in the surface of the metallic shell, thereby improving smoothness of the surface. However, it is understandable that the employment of a sufficiently large Ni plating thickness on the inner surface can ensure sufficient stress corrosion cracking resistance without need to perform the Ni strike plating process.¥

(7) Seventh Example (Effect of Cross-Sectional Area of Groove Portion)

In the seventh example, the effect of the cross-sectional area of the groove portion 1*h* on stress corrosion cracking resistance was evaluated. FIG. 12 is an explanatory view showing the experimental results of the seventh example. In the seventh example, metallic shell samples were prepared by performing all of the processes of steps T100 to T130 of FIG. 3. Processing conditions of steps T100 and T110 were similar to those of the first example; processing conditions of step T120 were similar to those of the second example; and processing conditions of step T130 were similar to those of the third example.

As shown in FIG. 12, similar to FIG. 11, there were tested a group of samples having a large Ni plating thickness on the inner surface of the metallic shell and a group of samples having a small Ni plating thickness on the inner surface of the metallic shell. In the group of samples having a large Ni plating thickness on the inner surface of the metallic shell, the Ni plating thickness on the outer surface of the hexagonal portion 1*e* was 5 μm, and the Ni plating thickness on the inner surface of the groove portion 1*h* was 0.3 μm. In order to attain these plating thicknesses, the Ni plating process in step T110 employed a plating time of 40 minutes and a cathode current density of 0.45 A/dm$^2$. In the group of samples having a small Ni plating thickness on the inner surface of the metallic shell, the Ni plating thickness on the outer surface of the hexagonal portion 1*e* was 5 μm, and the Ni plating thickness on the inner surface of the groove portion 1*h* was 0.1 μm. In order to attain these plating thicknesses, the Ni plating process in step T110 employed a plating time of 15 minutes and a cathode current density of 1.2 A/dm$^2$. The metallic shell samples in each group were prepared in such a manner as to be divided into subgroups which differed in the cross-sectional area of the groove portion 1*h*, ranging from 20 mm$^2$ to 44 mm$^2$.

These two groups of samples were subjected to the above-mentioned stress corrosion cracking resistance evaluation test. In this evaluation test, after the elapse of a test time of 24 hours, 100 samples were examined for the number of samples suffering from cracking. In the group of samples having a large Ni plating thickness on the inner surface of the metallic shell, the number of samples suffering from cracking was zero regardless of the cross-sectional area of the groove portion 1*h*. As for the group of samples having a small Ni plating thickness on the inner surface of the metallic shell, cracking occurred in samples in the subgroups having a cross-sectional area of the groove portion 1*h* of 20 mm$^2$ to 36 mm$^2$. It is understandable from these test results that employment of a large Ni plating thickness on the inner surface of the metallic shell is particularly effective for the metallic shells having a cross-sectional area of the groove portion 1*h* of 36 mm$^2$ or less.

(8) Eighth Example (Effect of Height of Groove Portion)

In the eighth example, the effect of the height of the groove portion 1*h* on stress corrosion cracking resistance was evaluated. FIG. 13 is an explanatory view showing the experimental results of the eighth example. In the eighth example, metallic shell samples were prepared by performing all of the processes of steps T100 to T130 of FIG. 3 under the same processing conditions as those of the seventh example.

As shown in FIG. 13, similar to FIG. 12, there were tested a group of samples having a large Ni plating thickness on the inner surface of the metallic shell and a group of samples having a small Ni plating thickness on the inner surface of the metallic shell. The Ni plating thicknesses and the conditions of preparing the samples are similar to those of the seventh example. These two groups of samples were subjected to the above-mentioned stress corrosion cracking resistance evaluation test. In this evaluation test, similar to the fourth example, stress corrosion cracking resistance was judged by time that elapsed before occurrence of cracking in the groove portion 1*h*. In the group of samples having a large Ni plating thickness on the inner surface of the metallic shell, the samples having a height (an axial length) of the groove portion 1*h* of 3 mm to 6.5 mm were free from cracking of the groove portion 1*h* even when the cumulative test time reached 80 hours. In the sample having a height of the groove portion 1*h* of 7 mm, cracking occurred at a cumulative test time of 20 hours to 50 hours. Meanwhile, in the group of samples having a small Ni plating thickness on the inner surface of the metallic shell, all of the samples having a height of the groove portion 1*h* of 3 mm to 7 mm suffered from cracking at a cumulative test time of 20 hours or less. Particularly, in the samples having a height of the groove portion 1*h* of 3.5 mm to 7 mm, cracking occurred at a cumulative test time of 10 hours or less. It is understandable from these test results that employment of a large Ni plating thickness on the inner surface of the metallic shell is particularly effective for the metallic shells having a height of the groove portion 1*h* of 3.5 mm to 6.5 mm.

The invention claimed is:

1. A spark plug comprising:

a tubular ceramic insulator having an axial bore extending therethrough in an axial direction;

a center electrode disposed at a forward end portion of the axial bore; and a metallic shell provided around the ceramic insulator;

the spark plug being characterized in that:

the metallic shell has:

a tool engagement portion projecting outward and having a polygonal orthogonal-to-axis sectional shape;

a gas seal portion projecting outward; and a groove portion formed between the tool engagement portion and the gas seal portion and having an orthogonal-to-axis sectional area of 36 $mm^2$ or less;

the metallic shell is covered with a nickel plating layer; and as measured at a forward end of an inner circumferential surface of the groove portion, the nickel plating layer has a thickness of 0.3 μm to 2.0 μm.

2. A spark plug comprising:

a tubular ceramic insulator having an axial bore extending therethrough in an axial direction;

a center electrode disposed at a forward end portion of the axial bore; and a metallic shell provided around the ceramic insulator;

the spark plug being characterized in that:

the metallic shell has:

a tool engagement portion projecting outward and having a polygonal orthogonal-to-axis sectional shape;

a gas seal portion projecting outward; and a groove portion formed between the tool engagement portion and the gas seal portion and having an orthogonal-to-axis sectional area of 36 $mm^2$ or less;

the metallic shell is covered with a nickel plating layer and has a chromium-containing layer formed on the nickel plating layer; and as measured at a forward end of an inner circumferential surface of the groove portion, the nickel plating layer has a thickness of 0.2 μm to 2.2 μm.

3. A spark plug comprising:

a tubular ceramic insulator having an axial bore extending therethrough in an axial direction;

a center electrode disposed at a forward end portion of the axial bore; and a metallic shell provided around the ceramic insulator;

the spark plug being characterized in that:

the metallic shell has:

a tool engagement portion projecting outward and having a polygonal orthogonal-to-axis sectional shape;

a gas seal portion projecting outward; and a groove portion formed between the tool engagement portion and the gas seal portion and having an orthogonal-to-axis sectional area of 36 $mm^2$ or less;

the metallic shell is covered with a nickel plating layer and has rust prevention oil applied onto the nickel plating layer; and as measured at a forward end of an inner circumferential surface of the groove portion, the nickel plating layer has a thickness of 0.2 μm to 2.2 μm.

4. A spark plug comprising:

a tubular ceramic insulator having an axial bore extending therethrough in an axial direction;

a center electrode disposed at a forward end portion of the axial bore; and a metallic shell provided around the ceramic insulator;

the spark plug being characterized in that:

the metallic shell has:

a tool engagement portion projecting outward and having a polygonal orthogonal-to-axis sectional shape;

a gas seal portion projecting outward; and a groove portion formed between the tool engagement portion and the gas seal portion and having an orthogonal-to-axis sectional area of 36 $mm^2$ or less;

the metallic shell is covered with a nickel plating layer and has a chromium-containing layer formed on the nickel plating layer, and rust prevention oil applied onto the chromium-containing layer; and as measured at a forward end of an inner circumferential surface of the groove portion, the nickel plating layer has a thickness of 0.1 μm to 2.4 μm.

5. A spark plug according to claim 1, wherein, as measured on an outer surface of the tool engagement portion, the nickel plating layer has a thickness of 3 μm to 15 μm.

6. A spark plug according to claim 1, wherein the metallic shell and the insulator accommodated in the metallic shell are fitted together by hot crimping.

7. A spark plug according to claim 1, wherein the groove portion has a height of 3.5 mm to 6.5 mm as measured in the axial direction.

8. A spark plug according to claim 2, wherein, as measured on an outer surface of the tool engagement portion, the nickel plating layer has a thickness of 3 μm to 15 μm.

9. A spark plug according to claim 3, wherein, as measured on an outer surface of the tool engagement portion, the nickel plating layer has a thickness of 3 μm to 15 μm.

10. A spark plug according to claim 4, wherein, as measured on an outer surface of the tool engagement portion, the nickel plating layer has a thickness of 3 μm to 15 μm.

11. A spark plug according to claim 2, wherein the metallic shell and the insulator accommodated in the metallic shell are fitted together by hot crimping.

12. A spark plug according to claim 3, wherein the metallic shell and the insulator accommodated in the metallic shell are fitted together by hot crimping.

13. A spark plug according to claim 4, wherein the metallic shell and the insulator accommodated in the metallic shell are fitted together by hot crimping.

14. A spark plug according to claim 2, wherein the groove portion has a height of 3.5 mm to 6.5 mm as measured in the axial direction.

15. A spark plug according to claim 3, wherein the groove portion has a height of 3.5 mm to 6.5 mm as measured in the axial direction.

16. A spark plug according to claim 4, wherein the groove portion has a height of 3.5 mm to 6.5 mm as measured in the axial direction.

* * * * *